United States Patent [19]

de Nora et al.

[11] 4,046,653

[45] Sept. 6, 1977

[54] NOVEL ELECTROLYSIS METHOD AND APPARATUS

[75] Inventors: Oronzio de Nora; Vittorio de Nora; Placido M. Spaziante, all of Milan, Italy

[73] Assignee: Oronzio de Nora Impianti Elettrochimici S.p.A., Milan, Italy

[21] Appl. No.: 580,952

[22] Filed: May 27, 1975

[30] Foreign Application Priority Data

Feb. 20, 1975 Italy ..... 20464/75

[51] Int. Cl.[2] ..... C25B 1/24

[52] U.S. Cl. ..... 204/95

[58] Field of Search ..... 204/95

[56] References Cited

U.S. PATENT DOCUMENTS

| | | | |
|---|---|---|---|
| 3,385,779 | 5/1968 | Nashiba et al. | 204/95 |
| 3,489,667 | 1/1970 | Colman et al. | 204/268 |
| 3,493,478 | 2/1970 | Udupa et al. | 204/95 |
| 3,539,486 | 11/1970 | Fleck | 204/95 |
| 3,616,443 | 10/1971 | Cook et al. | 204/95 |
| 3,640,804 | 2/1972 | Westerlund | 204/95 |
| 3,684,670 | 8/1972 | Raetzsch | 204/95 |
| 3,766,044 | 10/1973 | Westerlund | 204/95 |
| 3,849,281 | 11/1974 | Bennett et al. | 204/95 |

*Primary Examiner*—T. Tung

*Attorney, Agent, or Firm*—Hammond & Littell

[57] ABSTRACT

A novel process for the preparation of an alkali metal halate by electrolysis of an aqueous alkali metal halide solution comprising passing an alkali metal halide solution upwardly through a plurality of bipolar electrolysis units while passing an electrolysis current therethrough at a temperature of 90° to 110° C and at a current density to volume ratio of 15 to 30 A/liter to convert at least a portion of the alkali metal halide to alkali metal hypohalite, passing the resulting electrolyte while venting the hydrogen formed to a reaction zone whose volume is sufficient to provide a residence time to substantially complete the conversion of the alkali metal hypohalite to alkali metal halate and recovering the said halate from the electrolyte and an apparatus for performing the said process.

7 Claims, 7 Drawing Figures

NOVEL ELECTROLYSIS METHOD AND APPARATUS

STATE OF THE ART

Recent advancements in the production of alkali metal halates such as sodium chlorate have recognized the need for a rapid circulation of the electrolyte within the system formed by the electrolysis cells and the reactor.

According to this technique, electrolytic cells of the monopolar or bipolar type without diaphragms are coupled to a reactor, usually of dimensions much larger than those of the actual cells and the electrolyte contained in the reactor passes through the cell from the bottom towards the top and returns to the reactor. The circulation is provided by the upward thrust given to the electrolyte by the hydrogen bubbles which form on the cell cathodes.

In single-reactor systems operating in a continuous mode, the concentration of the various compounds contained in the electrolyte is held constant by taking off a certain quantity of the electrolyte containing the sodium chlorate therein produced and adding fresh brine to the circuit.

Other systems adopt a cascade configuration of units formed by one cell and the corresponding reactor and in this case, fresh brine is put into the first unit and the concentrated chlorate solution is extracted from the last reactor of the series. Systems of this kind are illustrated for example in U.S. Pats. Nos. 3,785,951 and 3,539,486.

The aim of such techniques is to favor the secondary or chemical dismutation of the chlorine produced by the electrolysis and to inhibit the anodic discharge and the cathodic reduction of the hypochlorite ions, which reduction tends to decrease the faraday efficiency of the process by imparting a rapid circulation of the electrolyte through the cell and by providing for a reaction time of the electrolyte in the reactor sufficient to favor the complete chemical dismutation of chlorine to chlorate, and, moreover, by carefully avoiding that recirculation or a slow motion of the electrolyte inside the electrolysis cell occurs, which technique had long been followed and whose latest developments can be found in U.S. Pats. Nos. 3,441,495; 3,489,667 and 3,766,044.

The various systems of this kind as they are known today have several shortcomings, a few of which are as follows. Conventionally, these systems operate with electrolyte temperatures of between 30° and 60° C, because few construction materials, which are also difficult to work, are able to withstand chlorate solutions at much higher temperatures. Since a remarkable amount of heat is generated by the electrolysis process, it is necessary in many instances to provide cooling means to maintain the temperature of the electrolyte at a level which does not jeopardize the mechanical and chemical stability of the construction materials. On the other hand, it is known from the literature that the rate of chemical dismutation of chlorine to chlorate increases with the temperature and consequently higher faraday efficiencies are reachable by operating at high temperatures.

Another technical compromise typical of the state of the art is represented by the fact that, to reduce the crossing time of the electrolyte through the electrolysis zone and thereby prevent parasitic anodic discharge or cathodic reduction of the hypochlorite thereby produced, the electrodes have small dimensions with respect to the direction of the flow of the electrolyte. This solution presents several disadvantages. The first consists of the necessity to provide a large overall cell cross-section perpendicular to the direction of flow and it is typical, in fact, to use a horizontal bipolar arrangement of electrodes whereby separate streams of electrolyte flow vertically through each bipolar section, as discussed in U.S. Pats. Nos. 3,785,951 and 3,759,815. This leads to a reduced speed of the electrolyte right in the zone where it should have instead the maximum speed. Furthermore, to impress the necessary circulation motion to the electrolyte by utilizing the gas lift of the evolved hydrogen bubbles and to avoid counter recirculation effects or sluggish motion, it becomes necessary to adopt verturi-type connections or otherwise to connect the cell to the dismutation reactor with pipes having a cross-section much smaller than the free cross-section of the cell. This in turn results in higher hydraulic energy losses in the circuit and further reduces the speed of the electrolyte in the electrolysis gap requiring a multiplicity of connections.

Potassium chlorate may also be produced by means of electrolysis of potassium chloride. However, this method has seldom ever been used in commercial plants of sizeable capacity because potassium chloride and potassium chlorate are not as soluble as sodium chloride and sodium chlorate at conventional temperatures (40°–60° C) of the electrolysis processes of the prior art. As a matter of fact, potassium chlorate is normally produced by reacting sodium chlorate produced by electrolysis and potassium chloride in aqueous media.

OBJECTS OF THE INVENTION

It is an object of the invention to provide a novel process for the preparation of alkali metal halates by electrolysis of alkali metal halides at temperatures of 90° to 110° C.

It is another object of the invention to provide a novel apparatus for the production of alkali metal halates in good yields and excellent faraday efficiency.

These and other objects and advantages of the invention will become obvious from the following detailed description.

THE INVENTION

The novel process of the invention for producing alkali metal halates by electrolysis of an aqueous alkali metal halide solution comprises passing an alkali metal halide solution upwardly through a plurality of bipolar electrolysis units while passing an electrolysis current therethrough at a temperature of 90° to 110° C and at a current density to volume ratio of 15 to 30 A/liter to convert at least a portion of the alkali metal halide to alkali metal hypohalite, passing the resulting electrolyte while venting the hydrogen formed to a reaction zone whose volume is sufficient to provide a residence time to substantially complete the conversion of the alkali metal hypohalite to alkali metal halate and recovering the said halate from the electrolyte.

According to the method of the invention, potassium chlorate is conveniently produced directly by electrolysis of a potassium chloride solution, since the high process temperature (90°–110° C) overcomes the limitations caused by the lower solubilities of potassium chloride and potassium chlorate as compared to the sodium compounds. Great plant investments are thus saved by replacing the indirect methods of potassium chlorate production typical of the prior art with the direct electrolysis method of the present invention.

The processs of the invention operates under the most favorable conditions. The high electrolyte temperature of 90° to 110° C, preferably 95° to 100° C, increases the electrolyte conductivity and favors a very high rate for dismutation of chlorine to chlorate. A very high halate concentration in the effluent is thereby reached. The speed of the electrolyte in traversing the electrolysis zone is very much higher than known processes due to the bipolar arrangement of the electrodes resulting in a sustained gas lift action by the cathodic gas (hydrogen). A streamlined configuration of the electrolysis cell and the reactor as well as the gas disengagement zone results in very low hydraulic losses and avoids any undesired stagnation zones or recirculation paths in the electrolysis zone.

With the method of the invention, a ratio of chlorate production capacity to total volume of reaction, which is more than double the value accepted today as commercially viable, is conveniently achieved. Said ratio is often called in literature "current concentration" and is expressed in amperes per unit of reaction volume which comprises the volume of the cell and of its corresponding reaction vessel.

Typical value of this ratio for commercial plants in use at present are between 2 and 11 A/l. In the apparatus of the present invention, said ratio is between 15 and 30 A/1.

In practical terms, this results in considerable plant investment and space saving for the same chlorate production capacity of the plant.

According to the present invention, the above-mentioned improvements are compatible with a high overall process efficiency and with apparatus of simple design which can be manufactured from readily available and low-cost materials.

The apparatus of the invention for the said electrolysis comprises a vertical electrolysis cell and a vertical reactor connected to the top of the electrolysis cell, means for discharging product from the reactor, means for maintaining the electrolyte level below the connection to the electrolysis cell, means for introducing fresh electrolyte into the reactor, means for impressing an electrolysis current on the cell and means for recycling electrolyte from the reactor bottom to the electrolysis cell bottom, said electrolysis cell being provided with a plurality of bipolar electrolysis units wherein the anodes and cathodes are interleaved to provide a vertical honey-comb effect, a gas disengagement space above the electrolysis cell and reactor and means for removing the disengaged gas.

In a preferred embodiment of the apparatus, there are provided means to add an acid such as hydrochloric acid to the system to control the pH of the electrolyte and means to add sufficient water to the system to make up for excessive evaporation of the electrolyte to prevent alkali metal halate crystallization in the apparatus at the operating temperature. Also, means may be provided to add an alkali metal chromate such as $NaCrO_7.H_2O$ as buffering agent up to a concentration of 2 grams per liter of electrolyte.

Referring now to the drawings.

Figure 1:
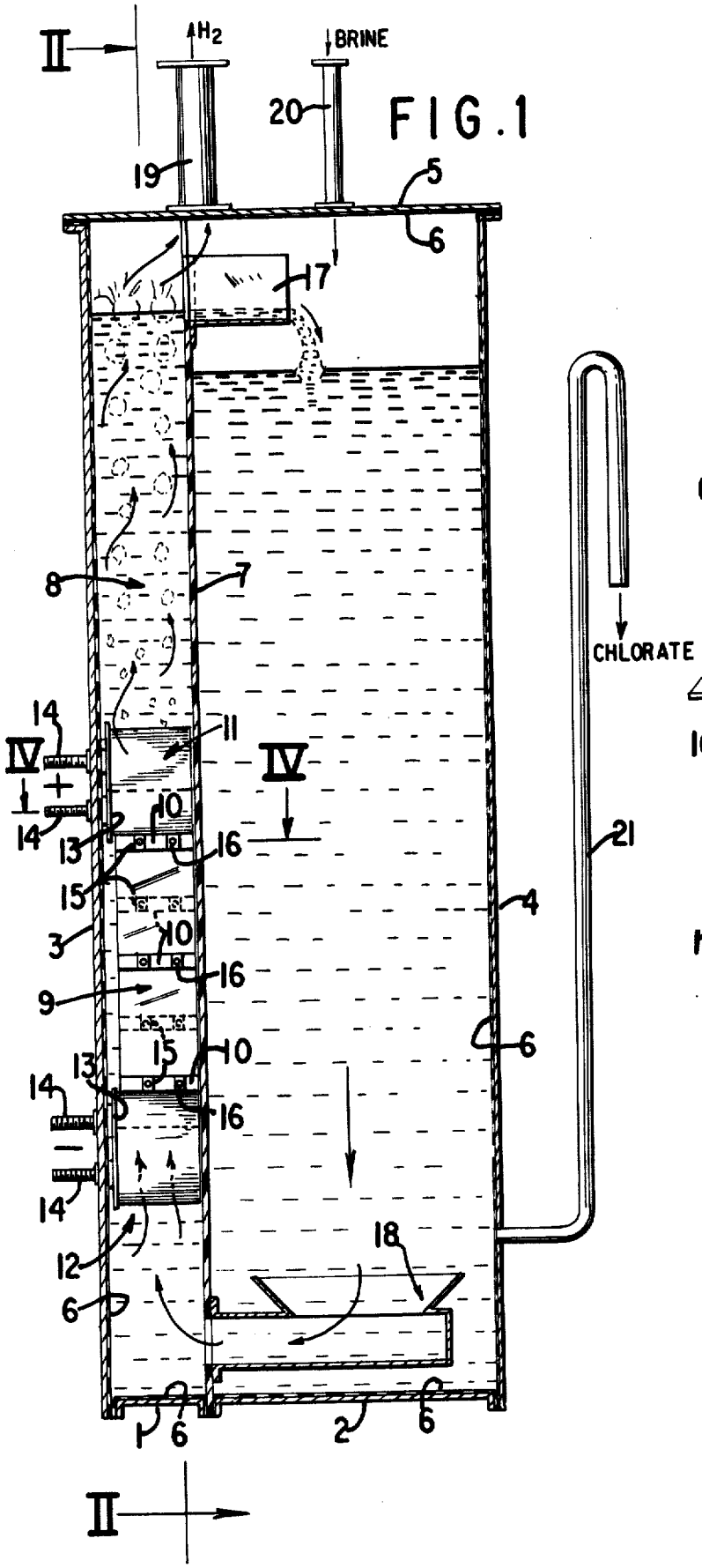
FIG. 1 is a cross-sectional view of one embodiment of the invention in which the electrolysis cell and reactor are in a single integral unit.
Figure 2:
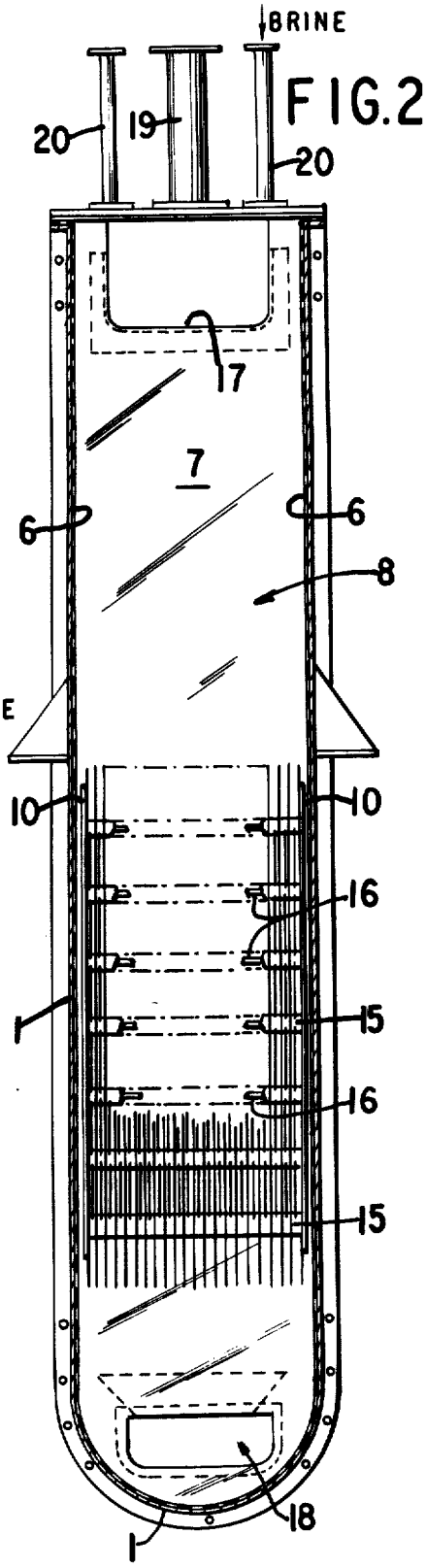
FIG. 2 is a cross-sectional view of the embodiment of the apparatus of FIG. 1 taken along the line II—II.

Referring now to FIGS. 1 and 2 in detail, the apparatus is formed by two elongated U-shaped flanged steel plates 1 and 2 which form the base of the electrolysis unit and the reactor unit, respectively. The side walls 3 and 4 are made of steel and are connected to the bases 1 and 2 and the top of the side walls are provided with a flat rectangular steel cover 5 over both the electrolysis unit and the reactor unit. This particular configuration may be conveniently clad on the interior thereof with commercially available polytetrafluoroethylene sheets of 1 to 3 mm thickness to protect the cell from the corrosive conditions occuring when operating in the presence of hypohalites at high temperatures. Unfortunately, polytetrafluoroethylene sheets can not be easily adhesively bonded to steel, can not be easily joined together and are only slightly pliable.

In the present construction, the side walls 3 and 4, the cover 5 and the base 1 and 2 have thin sheets 6 of polytetrafluoroethylene placed loosely over their interior surfaces and the ends of the sheets are held between adjacent elements of the cell, i.e. between side walls 3 and base 1. The sheets 6 can be conveniently secured in position by a few rivets applied externally to the gasketing surface. A separating wall 7 of polytetrafluoroethylene is clamped between U-shaped elements 1 and 2 to divide the container into an electrolysis unit and a reactor unit which communicate through top and bottom openings in wall 7. The first compartment 8 is the housing for bipolar vertical cell 9.

Figure 3:
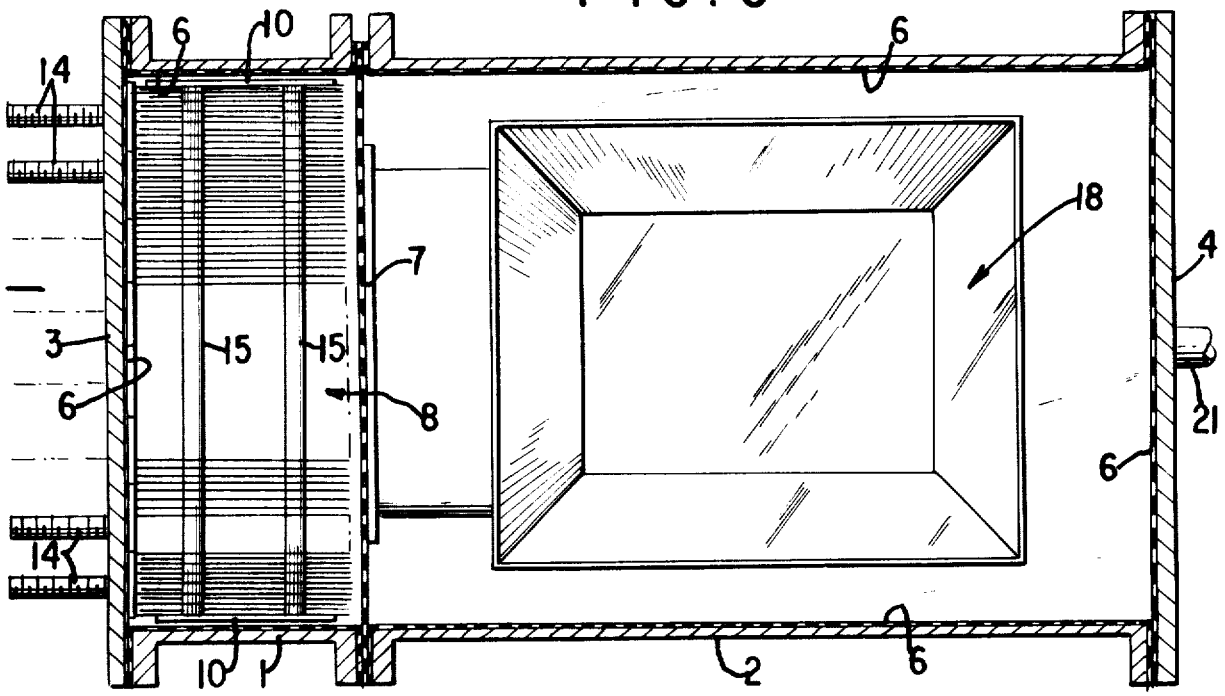
FIG. 3 is an enlarged partial cross-sectional view of the electrolysis of FIG. 1.
Figure 4:
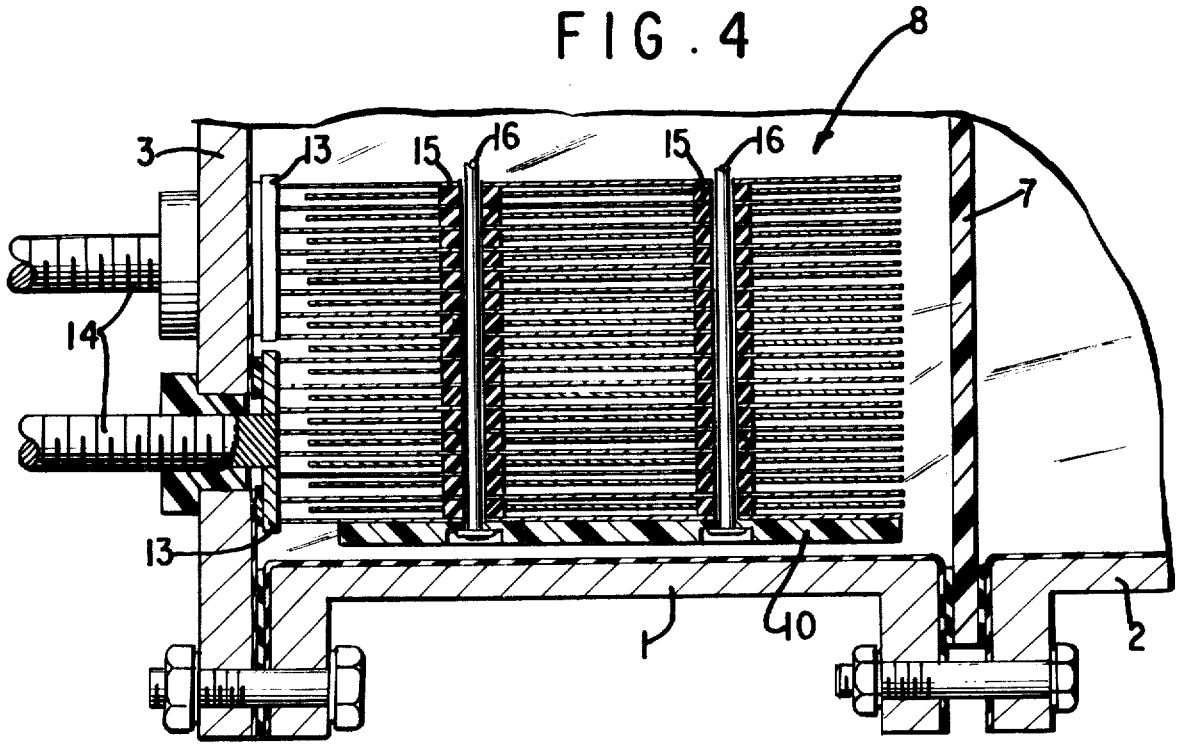
FIG. 4 is a plan cross-sectional view of the embodiment of FIG. 1 taken along the line IV—IV.

The vertical cell 9 is comprised of a vertical arrangement of interleaved electrodes which can be preassembled as an independent electrode pack which be secured on side walls 3 of the container. As can be more clearly seen from FIGS. 3 and 4, the electrode pack is comprised of two opposite retaining walls 10 made of a corrosion-resistant, insulating material such as polytetrafluoroethylene, two monopolar end groups of flat and parallel titanium electrodes 11 and 12 extending from two titanium end plates 13 provided with electrical connectors 14 which also act as the means for mounting the electrode assembly on side walls 3 and a plurality of bipolar groups of flat the parallel titanium electrodes interleaved with the electrodes of the adjacent lower and upper groups to form bipolar electrolysis units. The electrode assembly is completed by a plurality of polytetrafluoroethylene spacing buttons 15 aligned in the middle of the electrodes length through which titanium tie rods 16 pass and are tightened on the two walls 10.

The spacing buttons 15 are provided with horizontal grooves on their top and bottom surfaces and perform 2 functions; to space the adjacent electrodes of a unit apart and to retain the free ends of the electrodes of adjacent groups in the grooves so that a uniform and precise interelectrodic gap is maintained in all the individual cell units thereby avoiding short circuits. The spaced-apart buttons do not hinder in any substantial way the electrolyte flow through the electrode pack.

The complete electrode assembly occupies the entire cross-section of cell compartment 8 so that the electrode assembly acts hydraulically as a streamlined honeycomb elongated in the direction of electrolyte flow. Adjacent to the upper opening in the dividing wall, there is secured a titanium weir 17 to the dividing wall in the reactor and a titanium conveyor 18 is similarly secured adjacent the lower opening in the dividing wall 17 to provide means for passing electrolyte out of and into the electrolysis cell. The top of the reactor is provided with a hydrogen gas outlet 19 and a fresh brine inlet 20 and a product outlet 21 is provided near the bottom of the reactor which in the preferred embodiment is in the form of a gooseneck pipe to control the electrolyte level in the reactor.

In operation, fresh electrolyte enters the system through inlet nozzle 20 and the level of the liquor in the reaction compartment in maintained by the relative position of the gooseneck discharge pipe 21 below the level of the weir 17. Electric current flows from the positive monopolar group of electrodes through the electrolyte along the next interleaved bipolar group of electrodes, again through the electrolyte and to the next group of bipolar electrodes and eventually flows to the negative monopolar group of electrodes, to the end plate 13 and through connectors 14 to the negative supply bars. Hydrogen gas is evolved on the cathode surfaces in minute bubbles which rise through the electrolyte imparting a strong upward motion to the entire liquid mass contained in the vertical coil compartment, which tends to raise its level well above the hydraulic rest level. Therefore, the electrolyte discharges through the weir 17 back into the reaction compartment.

Several features of the invention contribute to greatly enhancing the circulation of the electrolyte within the system formed by the electrolysis cell compartment and the reaction compartment. The bipolar arrangement of the electrodes in the direction of the electrolyte motion provides for a sustained lifting action on the part of the hydrogen bubbles released from the cathode surfaces positioned at different levels along the direction of motion of the electrolyte. The bubbles maintain their original small diameter, become uniformly distributed within the mass of electrolyte which conditions have proved to be optimum for impressing a strong upward motion to the electrolyte contained in the cell compartment. The hydrogen bubbles, upon surfacing at the top of the liquids column 8, are easily disengaged from the rising liquor and the gas is released through the hydrogen outlet 19 without producing any undue turbulence or foaming effects which would introduce hydraulic losses. The electrolyte, lifted over the level of weir 17, discharges freely into the reaction tank, while an equal volume of electrolyte enters the cell compartment 8 through conveyor 18. The electrode assembly effectively provides the funcion of a fluid flow streamlining "honeycomb" and the absence of cross-sectional restrictions in the cell compartment above the electrodes minimizes the hydraulic losses within the system. The electrolyte speed is maximum within the electrolysis cell and may vary between 20 and 60 cm/sec, the preferred range being 30 to 50 cm/sec.

As brine if fed to the reactor by inlet 20 an equal volume of electrolyte is discharged through the outlet gooseneck pipe 21, to be utilized as such or to be conveyed to a halate recovery unit, whereby halate is separated from the residual halide solution which is then sent to the brine resaturation plant and recycled back into the system.

In accordance with the process of the invention, the temperature of the electrolyte is maintained between 90° and 110° C, preferably just below the boiling point of the solution. The heat is provided exclusively by the electrolysis process and stabilizing the temperature under the steady operation conditions of electric current density, brine feed rate and electrolyte withdrawal rate has been found to be conveniently achieved by providing suitable thermal insulation to the lower portion of the electrolysis cell.

Referring now for convenience to chlorate manufacture, the high temperature, the high speed of the electrolyte in traversing the electrolysis zone and its motion which is substantially laminar effectively prevent alkali metal hypochlorite reduction, even at high current densities, which according to the process of the invention range from 2000 to 6000 A/m$^2$. Furthermore, the high temperature and high electrolyte flow rate permit very high chlorate concentrations in the effluent to be reached, which besides being beneficial to the current efficiency as hypochlorite reduction in hindered, also requires less capacity in the chlorate recovering plant. Concentrations of chlorate in the effluent liquor may reach 700 grams per liter.

The ratio between the electrolysis current and the total volume of the cell compartment and the reaction compartment may vary between 15 and 30 amperes per liter which is very much higher than in conventional apparatus. It has been found that the volumetric ratio between the cell compartment and the reaction chamber should be less than 0.5, and preferably between 0.10 and 0.35.

Within the preferred range of this ratio, the hypochlorite produced by electrolysis completely reacts to chlorate before reaching again the electrolysis zone. The hypochlorite ion concentration in the electrolyte entering the electrolysis cell has been found to be less than 3 grams per liter which is completely tolerated by the process.

In a preferred embodiment of the invention, the electrodes are made of a single resistant support material such as a valve metal like titanium of tantalum coated only on the anode portion with an electroconductive and electrocatalytic coating comprised of mixed oxides of at least one valve metal and at least one platinum group metal such as rhodium, palladium, osmium, iridium, ruthenium and platinum. Anodic coatings of this type are described in U.S. Pats. Nos. 3,711,385 and 3,632,498. Other types of anodic coatings which are resistant to the corrosive environment of the cell may be used, such as platinum and plantinum alloy metallic coatings, although the noble metal losses in these latter cases can become relevant. The support material may also be a valve metal alloy such as titanium containing 0.1 to 5% by weight of palladium which reduces corrosion problems. The cathode portions of the electrodes may be a valve metal substrate coated with an alloy palladium-silver or palladium-lead.

Construction materials other than those described may be used. For instance, the entire container may be made of commercial glass reactors or of steel lined with polytetrafluoroethylene or any other suitable material.

The apparatus described in FIGS. 1 to 4 represents a preferred embodiment of the invention, but it should be understood the modifications may be made. In particular, the cell container and the reactor may be conceived as separate units as in FIGS. 5 and 6 and weir 17 and conveyor 18 may be replaced by pipe connections having a cross-section sufficiently large to minimize the hydraulic losses and to provide for an unrestricted overflow of the electrolyte from the level of the electrolyte in the cell container into the reactor and for an unrestricted gas disengagement over the top level of the electrolyte in the cell container and in the reactor.

Moreover, the apparatus of the invention may be operated in different modes. It may be operated in a batch mode, whereby it is first filled with fortified brine and electrolysis is conducted until the desired concentration of chlorate in the electrolyte has been reached, at which point the apparatus is drained and set ready for another batch; or else it may be operated continuously according to the method described above.

In practice, either the lowermost or uppermost group of electrodes is connected to the positive terminal of the power supply and the electrodes' blades, extending from the corresponding titanium end plates, act as anodes and they are provided with the catalytic anodic coating. The next intermediate groups of bipolar electrodes interleave with said monopolar group of anodes for about half of their length, which portions act as cathodes and the other half of their length interleaves with the next group of bipolar electrodes and act as anodes. Therefore, the intermediate bipolar electrodes are provided with anodic coating only in the half portion which, successive of the bipolar arrangement, act as an anode. Eventually, the last group of monopolar electrodes extending from the other titanium end plate are electrically connected to the negative pole of the power supply and act as cathodes, therefore they do not require coating or may have a Pb-Pd or Pd-Ag coating.

Figure 6:
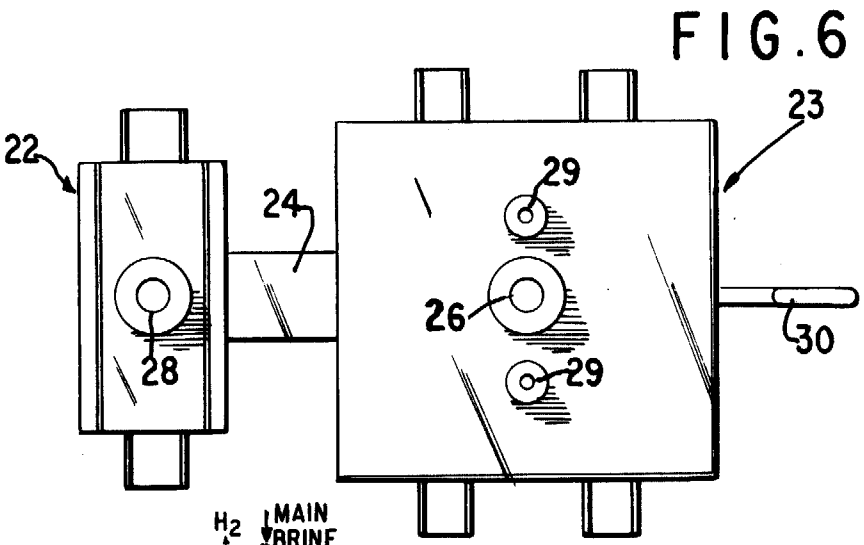
FIG. 5 is a side view of another embodiment of the invention in which the electrolysis cell and the reactor are two distinct units and FIG. 6 is a plan view of FIG. 5.
Figure 5:
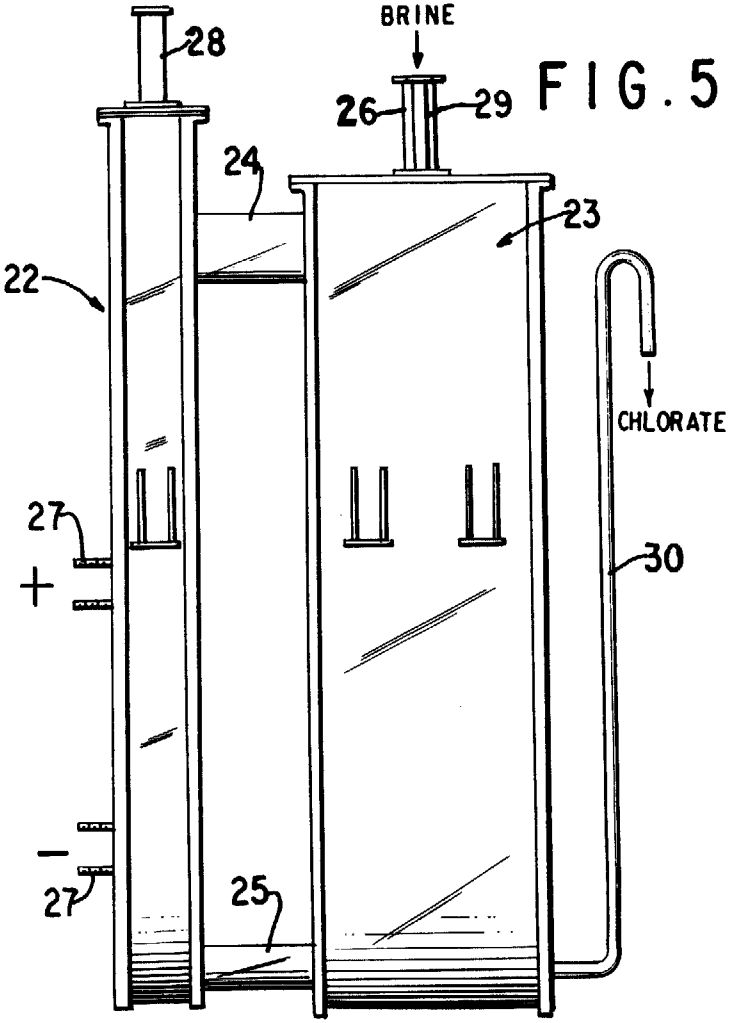

In the embodiment of FIGS. 5 and 6, the electrolysis cell 22 and the reactor 23 are two separate units connected by an upper connection 24 and a lower connection 25. Brine is introduced at the top of reactor 23 by inlets 29 and the electrolysis current is provided by electrical connection 27. The hydrogen gas formed is released within the gas space above connection 24 and is removed by gas outlet 28. A second hydrogen outlet 26 is provided on the cover of reactor 23. Fresh make up brine is added to the reactor by brine inlet 29 and chlorate is removed from the reactor by gooseneck outlet 30 which regulates the height of electrolyte in reactor 23.

Figure 7:
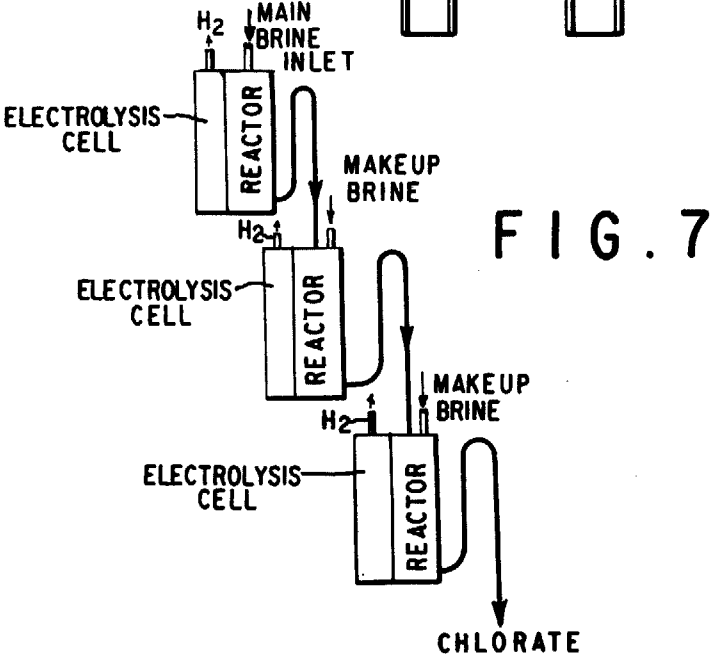
FIG. 7 is a schematic showing of a series of the apparatus of the invention in which the concentrate of the alkali metal chlorate increases in each unit.

In FIG. 7, there is illustrated an embodiment in which several units are connected in a cascade arrangement with brine being fed to the first unit with the chlorate solution being recovered from the final unit. Secondary brine inlets are provided also in the intermediate units as, in particular instances, it may be necessary to add fresh brine to one of the intermediate reactors to control the chlorate concentration in the various units of the series to avoid any undue crystallization within the units.

In the following examples there are described several preferred features to illustrate the invention. However, it should be understood that the invention is not intended to be limited to the specific embodiments.

EXAMPLE 1

Brine containing 310 grams per liter of sodium chloride and 2 grams per liter of sodium dichromate hydrate as a buffering agent was introduced into the apparatus of FIGS. 1 to 4 and the electrodic gap was 3.25 mm. The process was operated at an average electrolyte temperature of 98° C at a current density of 2200 A/m² and with an average electrolyte speed in the electrode gap of 40 cm/sec. The current concentration was 20 A/liter and the volume ratio of the electrolysis cell to reactor was 0.20. At steady state operating conditions, the electrolyte in the reactor contained 100 to 110 grams per liter of sodium chloride and 650 to 670 grams per liter of sodium chlorate and a pH of 6.5 to 6.9. The sodium hypochlorite concentration in the effluent was less than 2 grams per liter. The cell operated at an average cell voltage of 3.0 volts and a 96% current efficiency, the energy consumption was 4900 to 5400 KW hours per ton of sodium chlorate produced.

EXAMPLE 2

An aqueous solution containing 300 g per liter of potassium chloride and 2 g per liter of potassium dichromate hydrate as buffering agent was electrolyzed in the apparatus of FIGS. 1 to 4 to produce potassium chlorate. The process was operated at an average electrolyte temperature of 98° C at a current density of 2200 A/m² and with an average electrolyte speed in the electrodic gap of 40 cm per sec. The electrode gap was 3.25 mm and the current concentration was 20 A per liter with a volume ratio of electrolysis cell to reactor of 0.20. At steady state operating conditions, the electrolyte contained 90 g/1 of potassium chloride, 210 g/1 of potassium chlorate and had a pH of 6.5 to 6.8. The cell operated at a Faraday efficiency of 92%.

Various modifications of the process may be made without departing from the spirit or scope thereof and it is to be understood that the invention is to be limited only as defined in the appended claims.

We claim:

1. A process for the preparation of an alkali metal halate by electrolysis of an aqueous alkali metal halide solution comprising passing an alkali metal halide solution utilizing a sustained gas-lift effect of evolved hydrogen gas, upwardly through a vertically enlongated housing, a plurality of vertically stacked bipolar electrolysis units occupying substantially the entire cross-sectional area of the housing with vertical anodes and cathodes interleaved to provide a vertical honeycomb effect and to avoid recirculation of the electrolyte inside the compartment while passing an electrolysis current therethrough at a temperature of 90° to 100° C and at a electrolysis current to volume ratio of 15 to 30 A/liter to convert at least a portion of the alkali metal halide to alkali metal hypohalite and to alkali metal halate, providing for very low hydraulic pressure drop along the entire vertical path of the electrolyte, passing the resulting electrolyte, while venting the hydrogen formed, to a reaction zone whose volume is sufficient to provide a residence time to substantially complete the conversion of the alkali metal hypohalite to alkali metal halate and recovering the said halate from the electrolyte.

2. The method of claim 1 wherein the alkali metal halide is sodium chloride.

3. The method of claim 2 wherein the current density is 2000 to 6000 A/m² and the electrolyte speed is 35 to 55 cm per second.

4. The method of claim 1 wherein the alkali metal halide is potassium chloride.

5. The method of claim 1 wherein the average electrolyte speed through the electrolysis cell is 30 to 60 cm per second.

6. The method of claim 1 wherein the volume ratio of the electrolysis cell to the reaction chamber is less than 0.5.

7. The method of claim 6 wherein the said ratio is between 0.1 and 0.35.

* * * * *